US008958530B2

(12) United States Patent
Behling

(10) Patent No.: US 8,958,530 B2
(45) Date of Patent: Feb. 17, 2015

(54) METHOD AND DEVICE FOR LOAD DEPENDENT RESIZING OF A FOCAL SPOT OF AN X-RAY GENERATING DEVICE

(75) Inventor: Rolf Karl Otto Behling, Norderstedt (DE)

(73) Assignee: Koninklijke Philips N.V., Eindhoven (NL)

( * ) Notice: Subject to any disclaimer, the term of this patent is extended or adjusted under 35 U.S.C. 154(b) by 631 days.

(21) Appl. No.: 13/265,297

(22) PCT Filed: Apr. 19, 2010

(86) PCT No.: PCT/IB2010/051696

§ 371 (c)(1),
(2), (4) Date: Oct. 19, 2011

(87) PCT Pub. No.: WO2010/128416

PCT Pub. Date: Nov. 11, 2010

(65) Prior Publication Data

US 2012/0039443 A1 Feb. 16, 2012

(30) Foreign Application Priority Data

May 5, 2009 (EP) ..... 09159397

(51) Int. Cl.

| | |
|---|---|
| ***H05G 1/02*** | (2006.01) |
| ***H05G 1/46*** | (2006.01) |
| ***H05G 1/36*** | (2006.01) |
| ***H05G 1/54*** | (2006.01) |

(52) U.S. Cl.

CPC . *H05G 1/46* (2013.01); *H05G 1/36* (2013.01); *H05G 1/54* (2013.01)

USPC ..... 378/118

(58) Field of Classification Search

CPC ..... H05G 1/08; H05G 1/26; H05G 1/265; H05G 1/30; H05G 1/34; H05G 1/36; H05G 1/46; H05G 1/52; H05G 1/54; H01J 35/14

USPC ..... 378/114, 117, 118

See application file for complete search history.

(56) References Cited

U.S. PATENT DOCUMENTS

| | | | | |
|---|---|---|---|---|
| 4,158,138 | A | 6/1979 | Hellstrom | |
| 4,631,742 | A * | 12/1986 | Oliver | 378/113 |
| 4,797,905 | A * | 1/1989 | Ochmann et al. | 378/108 |
| RE33,634 | E | 7/1991 | Yanaki | |
| 5,907,595 | A * | 5/1999 | Sommerer | 378/136 |
| 6,181,771 | B1 | 1/2001 | Hell et al. | |
| 6,356,619 | B1 | 3/2002 | Nagy et al. | |
| 6,456,690 | B2 * | 9/2002 | Yamada et al. | 378/119 |
| 6,870,898 | B1 * | 3/2005 | von der Haar | 378/97 |
| 7,249,886 | B1 * | 7/2007 | Chao et al. | 378/207 |
| 7,286,644 | B2 | 10/2007 | Andrews | |

(Continued)

FOREIGN PATENT DOCUMENTS

| | | |
|---|---|---|
| CN | 101547648 A | 9/2009 |
| FR | 978570 A | 4/1951 |
| GB | 247568 | 9/1926 |
| GB | 247568 A | 9/1926 |

(Continued)

*Primary Examiner* — Thomas R Artman

(57) ABSTRACT

In an X-ray generating device (2) a temperature of a focal spot (21) may be determined. Furthermore a load condition is determined, which may also take into account a planned operation procedure of the X-ray generating device (2). The focal spot of the X-ray generating device is then automatically resizable based at least in part on the load condition.

22 Claims, 5 Drawing Sheets

(56) References Cited

U.S. PATENT DOCUMENTS

| | | | | |
|---|---|---|---|---|
| 7,496,180 | B1 * | 2/2009 | Subraya et al. | 378/137 |
| 2001/0050972 | A1 * | 12/2001 | Yamada et al. | 378/119 |
| 2009/0060140 | A1 * | 3/2009 | Subraya et al. | 378/125 |
| 2010/0061504 | A1 | 3/2010 | Proksa | |
| 2012/0039443 | A1 * | 2/2012 | Behling | 378/113 |

FOREIGN PATENT DOCUMENTS

| | | | |
|---|---|---|---|
| GB | 1357395 | A | 6/1974 |
| JP | 1975109692 | | 8/1975 |
| JP | 61218100 | | 9/1986 |
| WO | 2007110797 | A1 | 10/2007 |

* cited by examiner

METHOD AND DEVICE FOR LOAD DEPENDENT RESIZING OF A FOCAL SPOT OF AN X-RAY GENERATING DEVICE

TECHNICAL FIELD OF THE INVENTION

The present invention relates to X-ray generating technology in general.

BACKGROUND OF THE INVENTION

X-ray generating devices are employed for example in X-ray systems for medical applications. An X-ray generating device, also known as e.g. an X-ray tube, is used to generate electromagnetic radiation, which may be used for example for medical imaging applications.

Regularly, electrons are accelerated between a cathode element and an anode element within an evacuated housing of an X-ray generating device for producing X-rays. The electrons impinge on a part of the anode element called the focal spot, thus creating electromagnetic radiation.

Anode elements may be of a static nature or may be implemented as a rotating anode element.

By employing a rotating anode, the target, i.e. the area of impingement of the electrons or the focal spot, may be considered to be a stationary area on the surface of the rotating anode disk where moving elements of the target pass a stationary electron beam. Thus, by rotating the anode, the heat load acting on the focal spot and thus the anode may be spread over a larger circular area, increasing the possible power rating of the X-ray generating device substantially.

A further factor for generating X-rays is the temperature of the focal spot. Regularly, the focal spot heats up to about 2000 to 3000° C. during operation of the X-ray generating device.

For increasing the output of X-radiation, the flux of electrons impinging on the focal spot of the anode element is to be increased.

On the other hand, the size of the focal spot may be required to be limited to achieve a desired spatial resolution of the X-ray image With an according increase of the electron current and given the limited size of the focal spot, the temperature of the focal spot may also increase.

Thus, the combination of a pre-determined image resolution, i.e. the focal spot size and the desired X-radiation output, i.e. the power loading of the focal spot, may result in overheating the focal spot, which may result in a premature deterioration of the anode element or even in instantaneous catastrophic failure of the X-ray generating device.

SUMMARY OF THE INVENTION

Thus, there may be a need for a method and an apparatus in which overheating of a focal spot of an X-ray generating device may be prevented, in particular to avoid deterioration or failure of the anode element and the X-ray generating device, respectively.

To counteract a temperature increase of the focal spot due to an increase in electron impingement, the size of the focal spot may be enlarged to distribute the electrons impinging on the anode element over a larger area.

However, since a larger focal spot, thus a larger area of the generation of X-radiation, may result in an inferior X-ray image, the focal spot size may in particular be only enlarged in case a catastrophic failure of the X-ray generating device is imminent.

An according catastrophic failure may in particular be dependent on the current load, i.e. the amount of X-radiation generated, of the X-ray generating device, taking in account in particular the flux of electrons impinging on a focal spot with a defined size.

Regularly, the X-ray equipment may be designed and specified for a certain life time under specified load conditions. If an operator chooses to use the system to a lesser than expected extent, it may be beneficial to offer the benefit of an improved image resolution, i.e. a smaller focal spot, to the operator, without jeopardizing the reliability of the system.

In the following, a method for load dependent resizing of a focal spot of an X-ray generating device, an X-ray generating device, an X-ray system, a computer-readable medium and a program element according to the independent claims are provided.

According to an exemplary embodiment of the present invention, a method for load dependent resizing of a focal spot of an X-ray generating device is provided, the method comprising determining a load condition, wherein the focal spot is automatically resized based at least in part on the load condition.

According to a further exemplary embodiment of the present invention, an X-ray generating device is provided comprising a cathode element and an anode element, wherein the cathode element and the anode element are operatively coupled for generation of X-rays and wherein a focal spot is resizable, in particular automatically resizable, based at least in part on a first temperature and/or a load condition.

According to a further exemplary embodiment of the present invention, an X-ray system is provided, comprising an X-ray generating device according to the present invention and an X-ray detector, wherein an object is arrangeable between the X-ray generating device and the X-ray detector, wherein the X-ray generating device and the X-ray detector are operatively coupled such that an X-ray image of the object is obtainable and wherein the X-ray system is adapted to carry out the method according to the present invention.

According to a further exemplary embodiment of the present invention, a computer-readable medium is provided, in which a computer program for load dependent resizing of a focal spot of an X-ray generating device is stored, which computer program, when being executed by a processor, is adapted to carry out or control the method according to the present invention.

According to a further exemplary embodiment of the present invention, a program element for load dependent resizing of a focal spot of an X-ray generating device is provided, which program element, when being executed by a processor, is adapted to carry out or control the method according to the present invention.

The present invention relates to load dependent resizing of a focal spot of an X-ray generating device. A decision whether to resize the focal spot may in particular depend on a first temperature of a focal spot, e.g. arranged on an anode element of an X-ray generating device like for example an X-ray tube and/or on a load condition thereof.

A load condition may in particular be related to a certain operation or mode of operation of an X-ray generating device. Modes of operation may for example be the sub-second acquisition of a single X-ray image of e.g. a fractured bone, the acquisition of a computed tomography volume scan of several seconds duration, the acquisition of a series of images of some milliseconds shot length, e.g. during an operation, or may even be an acquisition of a cine sequence of a human heart in a cardiac application (for example with about 30 images per second over an extended period of time, like 20 seconds) using contrast dye.

A load condition may in particular become more demanding with any one of the power output of the X-ray generating device, extended operation, which may be continuous, decreasing focal spot size and may also be dependent on the temperature of the focal spot at the beginning of an operation of the X-ray generating device, herein referred to as the first temperature.

The first temperature of the focal spot may be determined before an operation of the X-ray generating device, in particular at the beginning of a planned operation. Taking into account the above-mentioned factors of the load condition as well as possibly the first temperature of the focal spot, a second temperature may be determined, which second temperature may be seen as the temperature of the focal spot after the planned or defined operation of the X-ray generating device.

If the first temperature is not available or chosen not to be determined, the worst case of the second temperature may at least be assessed or assumed.

Thus, by employing a load condition and/or taking into account the second temperature of the focal spot it may be determined whether the desired mode of operation of the X-ray generating device is within safe operation specification of the X-ray generating device.

Consequently, it may be determined that a certain mode of operation would result in a load condition that would lead to premature deterioration of the X-ray generating device or even catastrophic failure.

For example, an operator of an X-ray system planning a certain image acquisition operation may be informed that the planned operation is exceeding safety specifications of the X-ray system, e.g. by overheating of the focal spot track on the anode. The operator may then decide to re-plan the operation or whether to continue as planned while risking premature deterioration, at least risking reducing the life span or even catastrophic failure of the X-ray generating device.

In this case, re-planning the mode of operation may comprise reducing exposure time, decreasing X-radiation output and with it image contrast or enlarging the focal spot. However, enlarging the focal spot may worsen the spatial resolution of the X-ray image.

In a situation where a patient's safety takes precedence over material deterioration, an operator may still decide to continue an operation with a load condition including a focal spot size that may lead to premature deterioration.

While the operator may get an indication that a planned procedure would leave the safety boundaries of a certain manufacturer of an X-ray generating device, he may still decide to continue with a planned operation. This may be because the operator may decide during a certain mode of operation that e.g. the time planned for that certain operation is not required completely.

For example, in a cardiovascular application an operator may plan a real-time video sequence with a duration of 20 seconds. However, he may obtain the required images already within the first seven seconds and may thus decide to end the operation early.

On the other hand in case a planned mode of operation has to continue beyond e.g. a preset time limit, the operator may be informed that he is about to exceed manufacturer specifications. He then may still decide to continue with the preset parameters (e.g. focal spot size and power output) to maintain image quality or may decide to increase focal spot size to prevent damage to the X-ray generating device while sacrificing image quality.

Exceeding manufacturer specifications regularly may not lead to instantaneous catastrophic failure but rather decreases the life span of certain elements of an X-ray generating device.

In case a certain mode of operation is planned by an operator comprising parameters like for example focal spot size, power output and duration of operation of the X-ray generating device, it may be determined that, taking into account the first temperature of the focal spot and the load condition, the second temperature after the acquisition operation would still be within safety boundaries as stipulated by the manufacturer.

Accordingly, the operator may obtain an indication that, e.g. focal spot size may even be decreased for an increase in image quality while maintaining or even increasing patient safety.

In all cases, if during a certain mode of operation a potentially dangerous situation is determined (e.g. a catastrophic failure may be imminent, in particular by exceeding the maximum temperature allowed by the manufacturer of the X-ray generating device) the X-ray system may automatically enlarge the focal spot size so that the current temperature of the focal spot stays within a safe regime or drops (back) into a safe regime.

Though enlarging the focal spot may result in a gradually diminished diagnostic image quality, it may still be preferred over shutting down the operation of the X-ray generating device completely, thus possibly cutting off the acquisition of potentially valuable information. This holds particularly for interventional techniques, where the position of a catheter has to be monitored.

The electron beam employed for producing X-radiation may be generated by thermionic emission emanating from the cathode element of the X-ray generating device. The electrons are accelerated towards the anode element by an electric field, i.e. a voltage between the cathode element and the anode element.

An electromagnetic focusing element, e.g. at least one electromagnetic lens within the X-ray generating device, may focus the electron beam, thus defining the area of impingement of the electrons on the anode element, hereby creating the focal spot in a defined size and shape.

The determination of the first temperature, the second temperature, a current temperature of the focal spot during an operation of the X-ray generating device as well as a load condition, in particular how the current temperature is affected by the first temperature and the load condition may be determined in various ways.

In particular, the load condition may take into account the first temperature, i.e. the starting temperature before an operation of the X-ray generating device.

Furthermore, a second temperature after an operation of the X-ray generating device may depend on the first temperature and the load condition.

The current temperature of the focal spot during an operation of the X-ray generating device may in particular be between the first temperature and the second temperature and may be dependent on the first temperature and the load condition at a particular time during the operation of the X-ray generating device with parameters like focal spot size, power output of the X-ray generating device and current exposure time, i.e. the operation time of the X-ray generating device.

An according determination may be based on employing a temperature model or a thermodynamic model in general. An according model may be seen as a theoretical, mathematical model of how the temperature of the individual parts of the X-ray generating device, in particular the temperature of the focal spot of the anode element, changes over time e.g. taking into account parameters like first temperature, dynamic or static focal spot size, local focal spot current distribution, X-radiation power output, tube voltage, electron current, widening or shrinking focal spot size depending on tube voltage and current, electron recoil effects, effects of the current exposure time, overall exposure time, a current roughness of the target due to surface cracks and dose yield. The dose yield may further take into account an aging process of individual components of the X-ray generating device, in particular of the anode element, which may be seen as a correction parameter being related to the past overall operation of the X-ray generating device.

The model may require precise information about the current state or condition of the X-ray generating device as well as the planned procedure, thus the incorporation of the thermodynamic model into a control unit, used e.g. by the operator for controlling and setting the operation of the X-ray generating device and the X-ray system respectively, may be beneficial.

Furthermore, the temperature of the focal spot may be determined by an optical measurement, e.g. a measurement of infrared radiation or thermal radiation by, for example, a thermal camera. An according measurement may in particular take place within the X-ray generating device/the X-ray tube.

Also, the temperature of the focal spot may be determined by measuring its thermionic emission. Thermionic emission of the focal spot may be comparable to that of the cathode element for producing electrons, which are then accelerated towards the anode element, thus impinging on the focal spot. As with the thermionic emission of the cathode element, the thermionic emission of the anode element may in particular depend on the material of the anode element and the temperature of the focal spot. A localized electric field in the vicinity of the focal spot may be employed for detecting the respective electrons released from the anode element.

In other words, an X-ray generating device may be is adapted to measure the temperature of e.g. a target indirectly by measuring electrons, which are emitted from the target due to the effect of thermionic electron emission. As the thermal emission of electrons from the target per se may depend on the temperature of the target, the temperature of the target may be derived from an electron flow detected by the further electrode.

The temperature of the focal spot as well as the load condition may be depending on, thus being determined by the history of the loading sequence and using a thermal model.

With ageing of the anode element by thermo-mechanical cycling, the surface of the anode element may roughen due to e.g. surface cracks. With an according surface disruption, the decrease in dose yield of an X-ray generating device, i.e. the amount of X-radiation provided when being impinged by a certain amount of electrons, may result in an increase in temperature of the focal spot. That may be because the amount of electrons may have to be increased with decreased dose yield to obtain a given dose of X-radiation, and the thermal conduction worsens.

Accordingly, the age of the anode element, by taking into account in particular the previous operation of the X-ray generating device e.g. within or beyond manufacturer specifications, may influence the temperature. Accordingly, the dose yield may reflect a long time aging process of the X-ray generating device, in particular the anode element.

In the following, further embodiments of the present invention are described referring in particular to a method for load dependent resizing of a focal spot of an X-ray generating device. However, these explanations also apply to the X-ray generating device, the X-ray system, the computer-readable medium and the program element.

It is noted that arbitrary variations and interchanges of single or multiple features between the claimed entities are conceivable and within the scope and disclosure of the present patent application.

According to a further exemplary embodiment of the present invention a first temperature may be determined.

For determining the load condition, a first temperature of a focal spot may be determined, i.e. a starting temperature of the loading procedure from which to calculate the second temperature According to a further exemplary embodiment of the present invention, the load condition may be based at least in part of an operation of the X-ray generating device and/or a first temperature.

The load condition may thus take into account in particular parameters like desired focal spot size, exposure time of an operation as e.g. a preset way of how to acquire one or a set of X-ray images, power output of X-radiation, power input/amount of electrons impinging on the focal spot, a dose yield and the physical age of the X-ray generating device. The load condition may also take into account a first temperature, thus a starting temperature from which to calculate the second temperature.

According to a further exemplary embodiment of the present invention, the load condition is indicative for a second temperature of the focal spot after the operation of the X-ray generating device.

Thus, by employing the information about the parameters of the load condition, a second temperature of the focal spot after the pre-planned acquisition of the X-ray images may be determined, e.g. calculated by a physical model.

According to a further exemplary embodiment of the present invention, the first temperature and/or the second temperature may be determined by at least one out of the group consisting of a thermodynamic model, a temperature model, optical measuring, thermionic emission, determining dose yield and the load condition. Indirect parameters may include the actual and predicted focal spot size, either determined from parameters like tube voltage, tube current or measured.

This may allow for an easy and precise temperature determination and thus a determination whether the X-ray generating device is operating within manufacturer specifications.

According to a further exemplary embodiment of the present invention, the resizing of the focal spot may comprise enlarging the size of the focal spot and/or reducing the size of the focal spot or re-shaping the focal spot by changing the ratio of focal spot length and width Enlarging the size of the focal spot may in particular allow to react to an possibly imminent failure of the X-ray generating device, possibly damaging the X-ray generating device. Reducing the size of the focal spot may in particular allow to enhance the image quality when it is determined that an operation of the X-ray generating device is well within the manufacturer specification or the usage of the device is slow, compared with the conditions for which the device was once specified.

Furthermore, only the width or the length of the focal spot may be changed, thus the shape of the focal spot, or in other words, the aspect ratio between the focal spot length and the focal spot width may be changed.

For example, only the length or the width of the focal spot may be changed, thus the length or width of the focal spot may be changed independently from one another.

A change in the focal spot length in radial direction of a rotation anode element is directly, linearly linked to a change in focal spot temperature, whereas a change in focal spot width is linked via a square root dependency to the focal spot temperature.

According to a further exemplary embodiment of the present invention, the focal spot may be resizable before and/or during the operation of the X-ray generating device.

A resizing of the focal spot before the operation may in particular allow the acquisition of X-ray images with a substantially constant image quality while maximizing the constant image quality for a pre-planned operation. Resizing the focal spot during the operation of the X-ray generating device may in particular allow for a reaction to a possibly imminent failure of the X-ray generating device or may react to a change in the operation during the operation of the X-ray generating device, e.g. by prolonging the operation time (exposure time) beyond the pre-planned time limit, for which pre-planned time limit the size of the focal spot was initially chosen as being optimally adapted to the load condition, thus resulting in a second temperature, e.g. near the boundary of the manufacturer's specification.

According to a further exemplary embodiment of the present invention, the focal spot size may be enlarged during the operation of the X-ray generating device due to a current temperature of the focal spot during the operation and/or due to exceeding a predetermined load condition during operation in order to avoid deterioration of the X-ray generating device.

An according enlargement during the operation may counteract an imminent catastrophic failure or counteract premature aging of the X-ray generating device.

According to a further exemplary embodiment of the present invention, a focal spot size may be reduced before the operation of the X-ray generating device due to the first temperature of the focal spot, due to the second temperature of the focal spot and/or due to the load condition during operation of the X-ray generating device.

Reducing the focal spot size may in particular provide enhanced image quality with reduced patient risk in a mode of operation well within the boundaries of the manufacturer specifications that is determined while planning the operation of the X-ray generating device.

According to a further exemplary embodiment of the present invention, the focal spot size is resizable continuous and/or discontinuous.

A discontinuous or stepwise or gradually resizing of the focal spot may allow for an easy implementation of focal spot resizing while a continuous resizing may provide in particular a resizing that may be substantially optimal adapted to a current load condition while operating substantially at the safety boundary of the manufacturer.

In the following, further embodiments of the present invention are described referring in particular to an X-ray system. However, these explanations also apply to the method for load dependent resizing of a focal spot of an X-ray generating device, to an X-ray generating device, to a computer-readable medium and to a program element for load dependent resizing of a focal spot of an X-ray generating device.

According to a further exemplary embodiment of the present invention, the X-ray system may further comprise a temperature determining element for determining the first temperature of the focal spot, a current temperature of the focal spot and/or a second temperature of the focal spot.

An according temperature determining element may provide required information about the temperature of the focal spot e.g. to either provide a basis for commencing a mathematical calculation according to a thermodynamic model and/or to verify the accuracy of the temperature determined by employing the thermodynamic model.

The first temperature may in particular be the temperature before an operation, the current temperature in particular be the current temperature during an operation and the second temperature may in particular be the temperature of the focal spot after an operation of the X-ray generating device.

These and other aspects of the present invention will become apparent from and elucidated with reference to the embodiments described hereinafter.

Exemplary embodiments of the present invention will be described below with reference to the following drawings.

The illustration in the drawings is schematic. In different drawings, similar or identical elements are provided with the similar or identical reference numerals.

The figures are not drawn to scale, however may depict qualitative proportions.

DETAILED DESCRIPTION OF THE EMBODIMENTS

Figure 1:
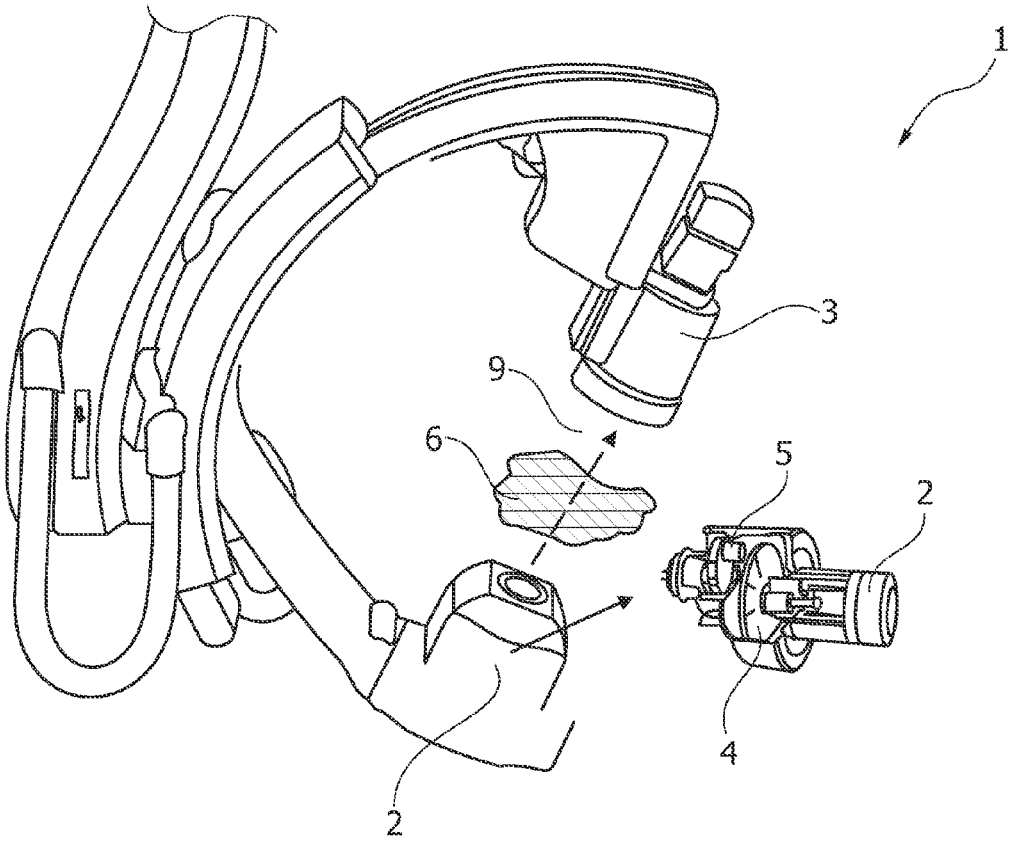
FIG. 1 shows an image acquisition part of an X-ray system according to an exemplary embodiment of the present invention.

Now referring to FIG. 1, an image acquisition part of an X-ray system according to an exemplary embodiment of the present invention is depicted.

X-ray system 1 comprises an X-ray generating device 2, here depicted as an X-ray tube, comprising a cathode 5 and a rotating anode 4. The X-ray generating device 2 is producing X-radiation, indicated by arrow 9.

An object 6 is situated in the path between the X-ray generating device 2 and an X-ray detector 3 so as to be exposed to and radiographed by X-radiation 9.

An X-ray detector 3 acquires an X-ray image or a series of images of object 6.

Figure 2:
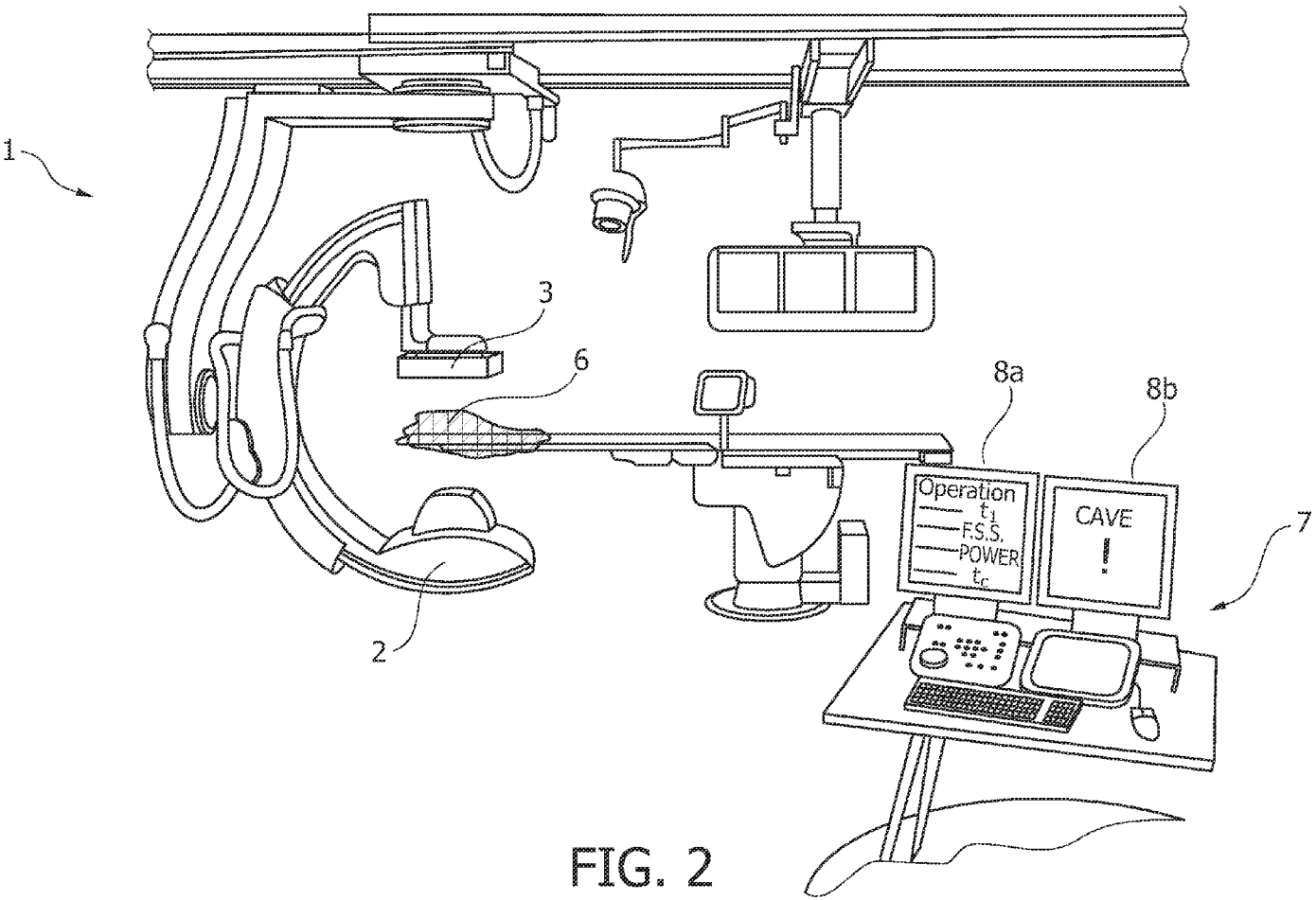
FIG. 2 shows a complete view of an X-ray system according to an exemplary embodiment of the present invention.

Now referring to FIG. 2, a complete view of an X-ray system according to an exemplary embodiment of the present invention is depicted.

In FIG. 2, the X-ray system 1 is depicted in a typical examination scenario including a control system or control station 7. Control system 7 is regularly located within a separate room or at least shielded from X-radiation 9.

An operator may use control system 7 to input parameters for an operation to be performed on object 6, e.g. instructions on how to obtain a single or a series of X-ray images of object 6.

For example, as depicted on monitor 8*a*, the operator is provided with information about the first temperature $t_1$ before an operation, about the focal spot size (F.S.S.), about the power output of the X-ray generating device 2 as well as the current temperature $t_c$.

The operator may enter data related to the planned operation of the X-ray generating device 2, like for example exposure time and number of frames to be acquired.

A program element or a computer program for load dependent resizing of a focal spot of an X-ray generating device 2 may be executed by a processor within control system 7.

Thus, the computer program or program element may instruct the processor/control system 7 to obtain information about the current temperature of the focal spot, thus a first temperature before the operation, a focal spot size, as well as information about the planned procedure.

Control system 7 may then use a thermodynamic model to determine a possible increase in focal spot temperature during the operation and in particular may determine the second temperature of the focal spot after the operation.

In case it is determined that the parameters of the planned operation result in a second temperature, which is not within safe specification limits of the manufacturer or a further arbitrary defined boundary condition, monitor 8*b* may display, for example, a warning, that the planned procedure exceeds this boundary condition. Alternatively, the system may provide an indication that the focal spot size will be automatically resized unless prevented by the user e.g. within a given time limit.

The operator may then decide to change operation parameters to re-enter/stay within specification boundaries or may choose to ignore the warning of the control system 7 on monitor 8*b* for the sake of improved X-ray image quality and enhanced patient safety while allowing the X-ray generating device 2 to age prematurely.

In case control system 7 determines that the preset parameters for the planned operation result in a second temperature of the focal spot which is within the boundary condition, it may also suggest to e.g. increase power output or to reduce focal spot size in order to obtain images of improved quality while still maintaining manufacturer specifications and upholding patient safely.

In case control system 7 determines that an imminent failure of the X-ray generating device 7 is to be expected due to the current temperature of the focal spot, it may decide to enlarge the focal spot automatically rather that completely shutting of X-ray acquisition instantaneously. Control system 7 may also inform the operator about this intervention and change in image parameters by signaling related information on monitor 8*b* (not depicted in FIG. 2).

Figure 3:
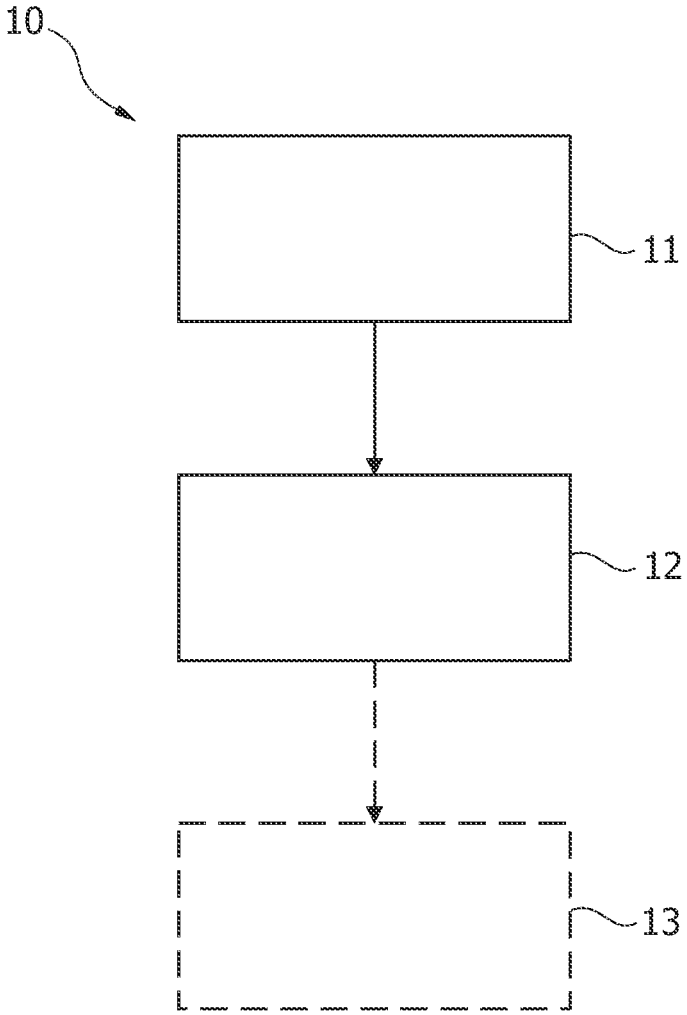
FIG. 3 shows a flow-chart diagram of the method for load dependent resizing of a focal spot of an X-ray generating device according to an embodiment of the present invention.

Now referring to FIG. 3, a flow-chart diagram of the method for load dependent resizing of a focal spot of an X-ray generating device according to the present invention is depicted.

The method 10 for load dependent resizing, in particular automatic resizing of a focal spot of an X-ray generating device comprises determining or assessing 11*a* load condition, possibly based at least in part on a first temperature.

As a next step, the method 10 comprises determining 12 a second temperature based at least in part on the load condition and/or a first temperature of a focal spot.

In case it is determined that an adjustment of focal spot size is required, e.g. due to exceeding manufacturer specifications, or on the other hand a reduction in focal spot size may result in improved image quality while maintaining patient safety, the focal spot may be resized, either enlarged or reduced, in a further step 13. In particular, the focal spot may be resized automatically, e.g. by control system 7 or by a safety element within the x-ray generating device.

Resizing 13 of the focal spot may take place before or during an operation of the X-ray generating device.

Figure 4:
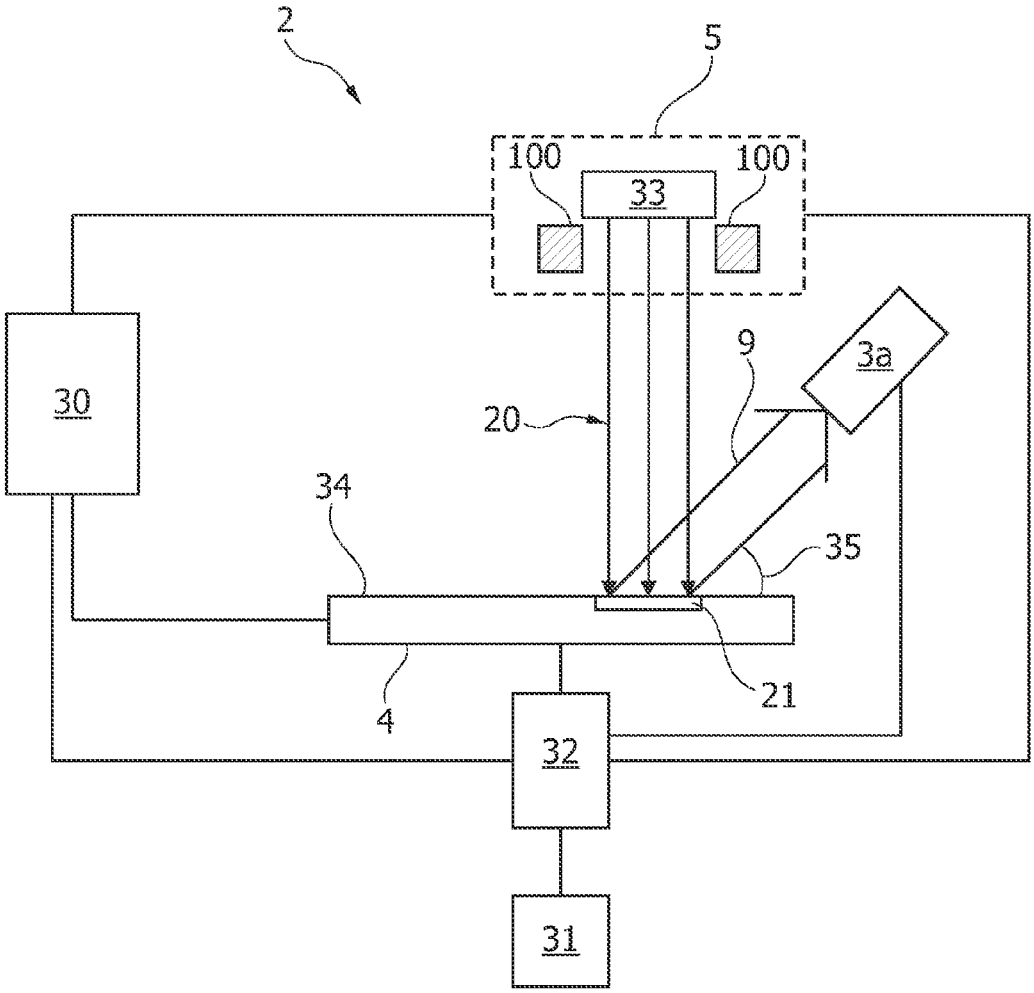
FIG. 4 shows a schematic drawing of an x-ray generating device 2 comprising focusing elements for focusing an electron beam according to an exemplary embodiment of the present invention.

FIG. 4 shows a schematic drawing of an x-ray generating device 2 comprising focusing elements for focusing an electron beam according to an exemplary embodiment of the present invention.

The x-ray generating device 2 comprises a cathode element 5, an anode element 4, e.g a rotating anode element 4, an X-ray detector 3*a*, a high-voltage source 30, a determination unit 31 and a control unit 32. The control unit 32 may be separated from or be a part of control system 7.

The cathode element 5 comprises an electron emitting element 33 and focusing elements 100 to focus the electron beam 20 on a predefined location in predefined dimensions on the anode element 4. The electron emitting element 44 emits an electron beam 20 comprising electrons accelerated towards the anode element 4 by an electric field generated by the high-voltage source 30.

The electrons impinge on the top surface 34 of the anode element 4 and form a focal spot 21. X-rays 9 emanate from the focal spot and are detected by the detector 3*a* which generates a detection signal. This detection signal may be used by the determination unit 31 to determine properties of the focal spot 21. These focal spot properties are, e.g., the dimensions or the position of the focal spot 21.

The determination unit 31 is adapted to determine the properties of the focal spot 21 according to the correlations between the changes of the detections signal.

The anode element 4, the cathode element 5, the high-voltage source 30, the detector 3*a* and the determination unit 6 are controlled by the control unit 32.

The detector 3*a* and the focal spot 21 may be arranged such that the angle 35 is as small as possible, wherein the detector 3*a* may still detect x-rays emanating from the focal spot 21. This may result in an improved sensitivity of the detection signal with respect to changes on the top surface 34 of the anode element 4.

Alternatively or additionally, the detector 3*a* may be adapted to detect other particles, like electrons or metal particles, emanating from the focal spot 21. Also in this case, the detector 3*a* and the focal spot 21 may arranged such that the angle 35 may be as small as possible, wherein the detector 3*a* may still detect these particles emanating from the focal spot. Thus, detector 3*a* may also be employed for the detection of a temperature of a focal spot 21 due to thermionic emission.

Figure 5:
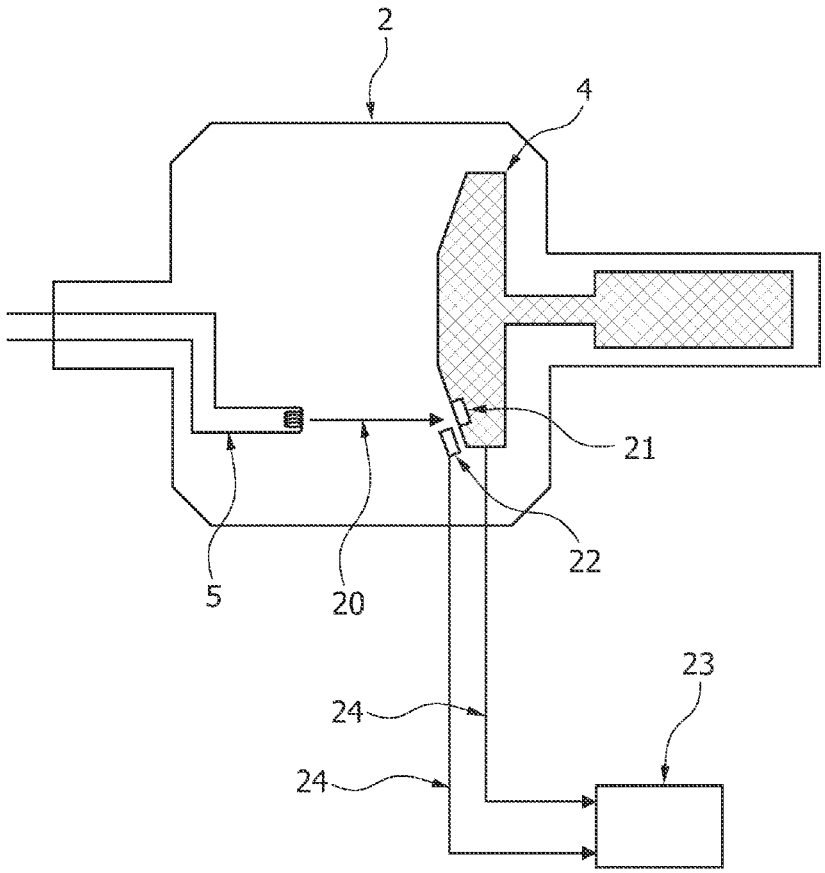
FIG. 5 shows a schematic representation of an X-ray generating device 2 comprising an electrode element 22 for the detection of electrons according to an exemplary embodiment of the present invention.

FIG. 5 shows a schematic representation of an X-ray generating device 2 comprising an electrode element 22 for the detection of electrons.

A hot cathode element 5 generates electrons 20 which are accelerated towards a target or focal spot 21 of an anode element 4. The electrons may be accelerated due to an electrical potential difference between the cathode element 5 and the target 21. The anode element 4 and the target 21 may be separated or, as illustrated, one and the same element. The target may be rotating. The plurality of accelerated electrons represents an electron beam 20. The electron beam 20 impacts onto the target 21 at the focal spot 21.

Due to the interaction of the electrons with the target material, X-rays are generated. Moreover, the target material is warmed up and further electrons may be emitted from the target 21 due to the effect of thermionic electron emission.

The electrons emitted from the target are detected by a further electrode element 22, e.g. a further anode element 22.

A backscattered electron capturing device may be arranged near the surface of the target (not illustrated in FIG. 5).

The X-ray generating device 2 may comprise an analyzing unit 23, which may be placed inside the X-ray generating device 2 or, as illustrated, outside the X-ray generating device 2.

Thus, a signal relating to temperature may be generated and transferred to the analysing unit 23 via lines 14 in order to be then processed in the analyzing unit 12 for determining of a temperature, e.g. the first, second or a current temperature of the focal spot 21.

It should be noted that the term "comprising" does not exclude other elements or steps and that "a" or "an" does not exclude a plurality. Also, elements described in association with different embodiments may be combined.

It should also be noted, that reference numerals in the claims shall not be construed as limiting the scope of the claims.

A computer-readable medium may be a floppy disk, a CD-ROM, a DVD, a harddisk, a USB (Universal Serial Bus) storage device, a RAM (Read Access Memory), a ROM (Read Only Memory) and an EPROM (Erasable Programmable Read Only Memory).

A computer-readable medium may also be a data communication network, e.g. the internet, which allows downloading a program code.

REFERENCE NUMERALS

1 X-ray system
2 X-ray generating device
3,3*a* X-ray detector
4 Anode element
5 Cathode element
6 Object
7 Control system
8*a,b* Monitor
9 X-Radiation
10 Method for determining a load condition of an X-ray generating device
11 Step 1: Determining a load condition
12 Step 2: Determining a second temperature
13 Step 3: Resizing of a focal spot
20 Electron beam
21 Target/focal spot
22 Further electrode element/anode element
23 Analyzing unit
24 Lines
30 High voltage source
31 Determination unit
32 Control Unit
33 Electron emitting element
34 Top surface
35 Angle
100 Focusing elements

The invention claimed is:

1. A method for load dependent resizing of a focal spot of an x-ray generating device, the method comprising:

determining that, due to overheating, catastrophic failure of said device is imminent; and, dynamically responsive to said determining that said failure is imminent, automatically enlarging said focal spot.

2. The method of claim 1, further comprising detecting a temperature, an outcome of said determining being based on the detected temperature.

3. An X-ray generating device comprising a cathode element and an anode element, the two elements being operatively coupled for generation of X-rays by irradiating said anode element at a focal spot of said anode element, said device further comprising an X-ray generation controller configured for:

determining that, due to overheating, catastrophic failure of said device is imminent; and, dynamically responsive to said determining that said failure is imminent, automatically resizing said focal spot.

4. The device according to claim 3, said controller being further configured for, at least one time, determining a temperature of said focal spot so as to automatically decide whether to resize said focal spot.

5. The device according to claim 4, the respective determining of said temperature entailing at least one out of the group consisting of a thermodynamic model, a temperature model, optical measuring, thermionic emission, determining dose yield, and determining the load condition.

6. The device according to 4, said controller being further configured for reducing a focal spot size before a particular operation of said device due to an assessment of at least one of a first temperature of the focal spot, a second temperature of the focal spot, and the load condition during operation of the X-ray generating device prior to said particular operation.

7. The device according to claim 3, said controller being further configured for automatically deciding whether to resize said focal spot based at least in part on at least one of a particular operation of said device being impending and a detected temperature of said focal spot.

8. The device according to claim 3, said controller being further configured for determining, after a particular operation of said device, a temperature, an outcome of the determining of said temperature being potentially determinative in automatically deciding that said overheating is imminent and consequently enlarging said focal spot.

9. The device according to claim 3, said focal spot having a size, said controller being further configured for resizing that involves enlarging said size.

10. The device according to claim 3, said controller being further configured for resizing focal spot selectively both before and during clinical operation of said device.

11. The device according to claim 3, said controller being further configured for enlarging said focal spot responsive to a current temperature of said focal spot during clinical operation said device.

12. The device according to claim 3, said controller being further configured for sizing said focal spot selectively either continuously or discontinuously.

13. An X-ray system comprising:

an X-ray generating device according to claim 3; and an X-ray detector;

wherein an object is arrangeable between the X-ray generating device and the X-ray detector; and wherein the X-ray generating device and the X-ray detector are operatively coupled such that an X-ray image of the object is obtainable.

14. An X-ray system according to claim 4, further comprising a temperature determining element, said controller being further configured for determining at least one of a first temperature of said focal spot, a current temperature of said focal spot and a second temperature of said focal spot.

15. The device of claim 13, said X-ray detector being configured for detecting X-rays emanating from said focal spot and for generating a detection signal.

16. The device of claim 15, further comprising a focal spot properties determination unit configured for using said detection signal to determine properties of said focal spot.

17. The device of claim 3, said controller being further configured for, in order to avoid deterioration of said device, enlarging said focal spot responsive to a predetermined load condition criterion being, during clinical operation of said device, met.

18. The device of claim 3, said overheating being characterized by a temperature that would cause said failure.

19. The device of claim 3, said controller being further configured for detecting a temperature, an outcome of said determining being based on the detected temperature.

20. A non-transitory computer-readable medium embodying a computer program for load dependent resizing of a focal spot, said program having instructions executable by a processor for performing a plurality of acts, among said plurality there being the acts of:

determining that, due to overheating, catastrophic failure of said device is imminent; and, dynamically responsive to said determining that said failure is imminent, automatically resizing, said focal spot.

21. The computer readable medium of claim 20, said resizing enlarging said focal spot.

22. The computer readable medium of claim 20, among said plurality there further being the act of detecting a temperature, an outcome of said determining being based on the detected temperature.

* * * * *